US005247738A

United States Patent [19]

Yoshii

[11] Patent Number: 5,247,738

[45] Date of Patent: Sep. 28, 1993

[54] METHOD FOR ASSEMBLING MOTOR DRIVEN FLUID COMPRESSOR

[75] Inventor: Yuji Yoshii, Takasaki, Japan

[73] Assignee: Sanden Corporation, Gunma, Japan

[21] Appl. No.: 966,399

[22] Filed: Oct. 26, 1992

[30] Foreign Application Priority Data

Oct. 24, 1991 [JP] Japan ..... 3-278104

[51] Int. Cl.[5] ..... B23P 15/00

[52] U.S. Cl. ..... 29/888.022; 418/55.1

[58] Field of Search ..... 29/888.022, 428; 418/55.1, 55.2, 55.4

[56] References Cited

U.S. PATENT DOCUMENTS

| | | | |
|---|---|---|---|
| Re. 19,961 | 5/1936 | Crane . | |
| 1,934,155 | 11/1933 | Deventer . | |
| 2,178,425 | 10/1939 | Johnson . | |
| 2,331,878 | 10/1943 | Wentworth . | |
| 3,463,091 | 3/1967 | Delsuc . | |
| 4,466,784 | 8/1984 | Hiraga . | |
| 4,696,629 | 9/1987 | Shiibayashi et al. | 29/888.022 |
| 4,811,471 | 3/1989 | Etemad et al. | 29/428 |
| 4,900,238 | 2/1990 | Shimizu et al. . | |
| 4,940,396 | 7/1990 | Shimizu et al. . | |
| 5,015,163 | 5/1991 | Iizuka | 418/55.1 |
| 5,042,150 | 8/1991 | Fraser, Jr. | 29/888.022 |
| 5,044,904 | 9/1991 | Richardson, Sr. | 29/888.022 |

FOREIGN PATENT DOCUMENTS

| | | |
|---|---|---|
| 059925 | 3/1982 | European Pat. Off. . |
| 58-172485 | 10/1983 | Japan . |
| 61-116089 | 6/1986 | Japan . |
| 61-113881 | 5/1987 | Japan . |

*Primary Examiner*—Irene Cuda

*Attorney, Agent, or Firm*—Baker & Botts

[57] ABSTRACT

A method for assembling a motor driven fluid compressor having a compression mechanism, such as a scroll type fluid compression mechanism and a drive mechanism which are contained within a hermetically sealed housing. The compression mechanism includes fixed and orbiting scrolls. The drive mechanism includes a drive shaft and a motor rotating the drive shaft. The housing is divided into first and second cup-shaped portions and a cylindrical portion. An opening end of the first cup-shaped portion is releasably and hermetically connected to one opening end of the cylindrical portion. An opening end of the second cup-shaped portion is releasably and hermetically connected to another opening end of the cylindrical portion. First, second and third sub-assemblies are separately prepared, and then are assembled into the compressor. The first sub-assembly is formed by the first cup-shaped portion and at least one internal component part of the compressor. The second sub-assembly is formed by the second cup-shaped portion and at least one internal component part of the compressor. The third sub-assembly is formed by the cylindrical portion and the remainder of the internal component parts of the compressor. Accordingly, the compressor can be easily assembled under a flexible management.

8 Claims, 6 Drawing Sheets

METHOD FOR ASSEMBLING MOTOR DRIVEN FLUID COMPRESSOR

BACKGROUND OF THE INVENTION

1. Technical Field of the Invention

This invention relates to a fluid compressor, and more particularly to a method for assembling a motor driven fluid compressor having the compression and drive mechanisms within a hermetically sealed container.

2. Description of the Prior Art

Motor driven fluid compressors having the compression and drive mechanisms within a hermetically sealed housing are known in the art. For example, Japanese Patent Application Publication No. 2-275085 discloses a compressor including a hermetically sealed housing which contains a compression mechanism, such as a scroll type fluid compression mechanism and a drive mechanism therein. The housing includes a cylindrical portion, and a first and second cup-shaped portions. An opening end of the cylindrical portion is hermetically connected to one opening end of the cylindrical portion by, for example, brazing. An opening end of the second cup-shaped portion is hermetically connected to another opening end of the cylindrical portion by, for example, brazing.

The scroll type fluid compression mechanism includes a fixed scroll having a first circular end plate and a first spiral element which extends from one end surface of the first circular end plate. An inner block is fixedly disposed within one opening end region of the cylindrical portion by, for example, forcible insertion and is fixedly connected to the first circular end plate of the fixed scroll by a plurality of bolts. The scroll type fluid compression mechanism further includes an orbiting scroll having a second circular end plate and a second spiral element which extends from one end surface of the second circular end plate. The orbiting scroll is disposed within a hollow space which is defined by the inner block and the fixed scroll. The first spiral element of the fixed scroll interfits with the second spiral element of the orbiting scroll with an angular and radial offset. The first circular end plate of the fixed scroll is radially slidably disposed on one end surface of the inner block.

A drive mechanism includes a drive shaft and a motor surrounding the drive shaft. The drive shaft includes a pin member which extends from and is integral with one end of the drive shaft. The axis of the pin member is radially offset from the axis of the drive shaft, and the pin member is operatively connected to the second circular end plate of the orbiting scroll.

A rotation preventing mechanism is disposed between the inner block and the second circular end plate of the orbiting scroll so that the orbiting scroll only orbits during rotation of the drive shaft. The inner block includes a central bore through which the drive shaft passes. A bearing is fixedly disposed within one opening end portion of the central bore so as to rotatably support one end portion of the drive shaft.

The motor includes an annular-shaped rotor fixedly surrounding an exterior surface of another end portion of the drive shaft and an annular-shaped stator surrounding the rotor with a radial air gap. The stator of the motor is fixedly disposed within a middle region of the cylindrical portion by, for example, forcible insertion.

According to the above-mentioned construction of the compressor, all of the internal component parts are assembled within only the cylindrical portion of the compressor housing in an assembling process of the compressor. In a final step of the assembling process, the first and second cup-shaped portions are hermetically connected to one and another opening ends of the cylindrical portion respectively so that the assembling process of the compressors is completed.

Accordingly, in the final step of the assembling process, the weight of the assembled cylindrical portion takes an extremely high percentage of the total weight of the compressor. Therefore, the assembled cylindrical portion is handled with difficulty when the assembled cylindrical portion is required to be transported or to change its position during the final step of the assembling process.

Furthermore, according to the above-mentioned construction of the compressor, the compressor must be assembled along only one assembly line. Therefore, even when a part of the assembly line gets out of order, the whole of the assembly line does not work so that the assembly line can not be flexibly managed.

SUMMARY OF THE INVENTION

It is an object of the present invention to easily assemble a motor driven fluid compressor having the compression and drive mechanisms within a hermetically sealed container.

It is another object of the present invention to assemble a motor driven fluid compressor having the compression and drive mechanisms within a hermetically sealed container under a flexible management.

The present invention is directed to an assembling process of a compressor. The compressor comprises a compressing mechanism for compressing a gaseous fluid and a driving mechanism for driving the compressing mechanism. The driving mechanism includes a drive shaft operatively connected to the compressing mechanism. Both ends of the drive shaft are rotatably supported by a compressor housing through a pair of bearings, respectively. The driving mechanism further includes a motor which comprises a rotor fixedly surrounding the drive shaft and a stator which surrounds the rotor with a radial air gap. The compressing mechanism includes a scroll type fluid compression mechanism having a fixed scroll and an orbiting scroll.

The housing includes a first and second cup-shaped portions and a cylindrical portion. An opening end of the first cup-shaped portion is releasably and hermetically connected to one opening end of the cylindrical portion with a faucet joint. An opening end of the second cup-shaped portion is releasably and hermetically connected to another opening end of the cylindrical portion with a faucet joint. The housing contains the compressing mechanism and the driving mechanism.

A first sub-assembly is formed by the first cup-shaped portion and at least one internal component part of said compressor, such as the fixed scroll. A second sub-assembly is formed by the second cup-shaped portion and the other at least one internal component part of said compressor, such as the stator of the motor. A third sub-assembly is formed by the cylindrical portion and the remainder of the internal component parts of the compressor.

In an assembling process of the compressor, the first, second and third sub-assemblies are separately prepared, and then are assembled into the compressor.

It is another object of the invention to create a fluid compressor which is easily disassembled as well as assembled thereby further increasing the flexibility of its use.

DETAILED DESCRIPTION OF THE PREFERRED EMBODIMENTS

In FIGS. 1-6, for purposes of explanation only, the left side of the figures will be referenced as the forward end or front of the compressor, and the right side of the figures will be referenced as the rearward end or rear of the compressor.

Figure 1:
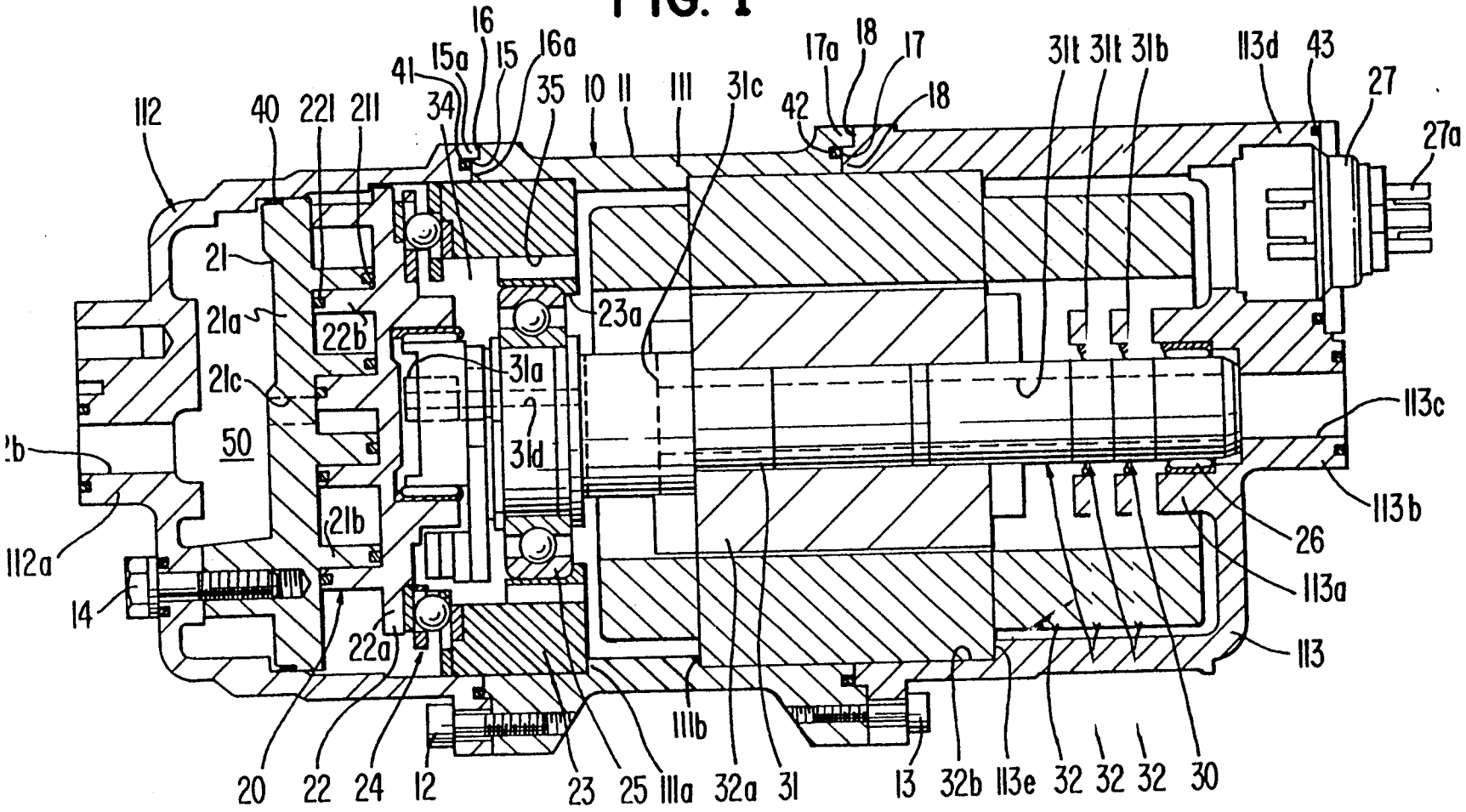
FIG. 1 is a longitudinal sectional view of a motor driven fluid compressor in accordance with a first embodiment of the present invention.

With reference to FIG. 1, an overall construction of a motor driven fluid compressor, such as a motor driven scroll type fluid compressor 10 in accordance with a first embodiment of the present invention is shown. Compressor 10 includes compressor housing 11 which contains a compression mechanism, such as scroll type fluid compression mechanism 20 and drive mechanism 30 therein. Compressor housing 11 includes cylindrical portion 111, and first and second cup-shaped portions 112 and 113. An opening end of first cup-shaped portion 112 is releasably and hermetically connected to a front opening end of cylindrical portion 111 by a plurality of bolts 12. An opening end of second cup-shaped portion 113 is releasably and hermetically connected to a rear opening end of cylindrical portion 111 by a plurality of bolts 13.

Scroll type fluid compression mechanism 20 includes fixed scroll 21 having circular end plate 21*a* and spiral element 21*b* which rearwardly extends from circular end plate 21*a*. Circular end plate 21*a* of fixed scroll 21 is fixedly disposed within first cup-shaped portion 112 by a plurality of bolts 14. Inner block 23 is fixedly disposed at the front opening end of cylindrical portion 111 of compressor housing 11 by forcible insertion. An outer periphery of a rear end surface of inner block 23 is in contact with a side wall of first annular ridge 111*a* which is formed at an inner peripheral surface of cylindrical portion 111. Scroll type fluid compression mechanism 20 further includes orbiting scroll 22 having circular end plate 22*a* and spiral element 22*b* which forwardly extends from circular end plate 22*a*. Spiral element 21*b* of fixed scroll 21 interfits with spiral element 22*b* of orbiting scroll 22 with an angular and radial offset.

Seal element 211 is disposed at an end surface of spiral element 21*b* of fixed scroll 21 so as to seal the mating surfaces of spiral element 21*b* of fixed scroll 21 and circular end plate 22*a* of orbiting scroll 22. Similarly, seal element 221 is disposed at an end surface of spiral element 22*b* of orbiting scroll 22 so as to seal the mating surfaces of spiral element 22*b* of orbiting scroll 22 and circular end plate 21*a* of fixed scroll 21. O-ring seal element 40 is elastically disposed between an outer peripheral surface of circular end plate 21*a* of fixed scroll 21 and an inner peripheral surface of first cup-shaped portion 112 to seal the mating surfaces of circular end plate 21*a* of fixed scroll 21 and first cup-shaped portion 112. Circular end plate 21*a* of fixed scroll 21 and first cup-shaped portion 112 define discharge chamber 50.

Circular end plate 21*a* of fixed scroll 21 is provided with valved discharge port 21*c* axially formed therethrough so as to link discharge chamber 50 to a central fluid pocket (not shown) which is defined by fixed and orbiting scrolls 21 and 22. First cup-shaped portion 112 includes cylindrical projection 112*a* forwardly projecting from an outer surface of a bottom end section thereof. Compressed fluid is discharged from the central fluid pocket through the valved discharge port 21*c* and into discharge chamber 50. Discharge chamber 50 is connected to an exterior cooling unit through axial hole 112*b*. Axial hole 112*b* functioning as an outlet port of the compressor is centrally formed through cylindrical projection 112*a* so as to be connected to an inlet of one element, such as a condenser (not shown) of an external cooling circuit through a pipe member (not shown).

Drive mechanism 30 includes drive shaft 31 and motor 32 surrounding drive shaft 31. Drive shaft 31 includes pin member 31*a* which forwardly extends from and is integral with a front end of drive shaft 31. The axis of pin member 31*a* is radially offset from the axis of drive shaft 31, and pin member 31*a* is operatively connected to circular end plate 22*a* of orbiting scroll 22. Rotation preventing mechanism 24 is disposed between inner block 23 and circular end plate 22*a* of orbiting scroll 22 so that orbiting scroll 22 only orbits during rotation of drive shaft 31.

Inner block 23 includes a central hole 23*a* of which the longitudinal axis is concentric with the longitudinal axis of cylindrical portion 111. Bearing 25 is fixedly disposed within central hole 23*a* so as to rotatably support a front end portion of drive shaft 31. Second cup-shaped portion 113 includes annular cylindrical projection 113*a* forwardly projecting from a central region of an inner surface of a bottom end section thereof. The longitudinal axis of annular cylindrical projection 113*a* is concentric with the longitudinal axis of second cup-shaped portion 113. Bearing 26 is fixedly disposed within annular cylindrical projection 113*a* so as to rotatably support a rear end portion of drive shaft 31. Second cup-shaped portion 113 further includes cylindrical projection 113*b* rearwardly projecting from a central region of an outer surface of the bottom end section thereof.

Axial hole 113*c* functioning as an inlet port of the compressor is centrally formed through cylindrical projection 113*b* so as to be connected to an outlet of another element, such as an evaporator (not shown) of the external cooling circuit through a pipe member (not shown). The longitudinal axis of axial hole 113*c* is concentric with the longitudinal axis of annular cylindrical projection 113*a*. A diameter of axial hole 113*c* is slightly smaller than an inner diameter of annular cylindrical projection 113*a*.

Drive shaft 31 includes first axial bore 31*b* axially extending therethrough. One end of first axial bore 31*b* is opened at a rear end surface of drive shaft 31 so as to be adjacent to a front opening end of axial hole 113*c*. The other end of first axial bore 31*b* terminates at an inlet chamber which is rear to bearing 25. A plurality of radial bores 31*c* is formed at the front terminal end of first axial bore 31*b* so as to like the front terminal end of first axial bore 31*b* to an inner hollow space of cylindrical portion 111 of housing 11. Second axial bore 31*d* axially extends from the front terminal end of first axial bore 31*b* and is opened at a front end surface of pin member 31*a* of drive shaft 31. A diameter of second axial bore 31*d* is smaller than a diameter of first axial bore 31*b*, and the longitudinal axis of second axial bore 31*d* is radially offset from the longitudinal axis of first axial bore 31*b*.

Fluid travels from an external source, such as an evaporator, into the compressor through axial hole 113*c*, through first axial bore 31*b* of drive shaft 31, into the inlet chamber, through second axial bore 31*d*, and discharges into a space between the orbiting scroll and the fixed scroll forming at least one fluid pocket which, when the fluid compressor is operating, travels centrally with decreasing volume between the scroll plates and discharges fluid through the valved discharge port of the fixed scroll into the discharge chamber.

Annular cylindrical projection 113*d* rearwardly projects from one peripheral region of the outer surface of the bottom end section of second cup-shaped portion 113. One portion of annular cylindrical projection 113*d* is integral with one portion of cylindrical projection 113*b*. Hermetic seal base 27 is firmly secured to a rear end of annular cylindrical projection 113*d* by a plurality of bolts (not shown). O-ring seal element 43 is elastically disposed at a rear end surface of annular cylindrical projection 113*d* so as to seal the mating surfaces of hermetic seal base 27 and annular cylindrical projection 113*d*. Wires 27*a* extend from the rear end of stator 32*a* of motor 32, and pass through hermetic seal base 27 for connection to an external electric power source (not shown).

Motor 32 includes annular-shaped rotor 32*a* fixedly surrounding an exterior surface of drive shaft 31 and annular shaped stator 32*b* surrounding rotor 32*a* with a radial air gap. Stator 32*b* axially extends along the rear opening end region of cylindrical portion 111 and the opening end region of second cup-shaped portion 113 between a second annular ridge 111*b* formed at an inner peripheral surface of cylindrical portion 111 and a third annular ridge 113*e* formed at an inner peripheral surface of second cup-shaped portion 113. Second annular ridge 111*b* is located at a rear to first annular ridge 111*a*. The axial length of stator 32*b* is slightly smaller than an axial distance between second annular ridge 111*b* and third annular ridge 113*e*. In an assembling process of the compressor, stator 32*b* is forcibly inserted into either the rear opening end region of cylindrical portion 111 until an outer peripheral portion of a front end surface of stator 32*b* is in contact with a side wall of second annular ridge 111*b* as illustrated in FIG. 2 or the opening end region of second cup-shaped portion 113 until an outer peripheral portion of a rear end surface of stator 32*b* is in contact with a side wall of third annular ridge 113*e* as illustrated in FIG. 3.

First annular cut-out section 15 is formed at an inner periphery of the opening end surface of first cup-shaped portion 112 of compressor housing 11. Consequently, first annular projection 15*a* is formed at an outer periphery of the opening end surface of first cup-shaped portion 112. The longitudinal axis of an inner periphery of first annular projection 15*a* is concentric with the longitudinal axis of first cup-shaped portion 112. Second annular cut-out section 16 is formed at an outer periphery of the front opening end surface of cylindrical portion 111 of compressor housing. Consequently, second annular projection 16*a* is formed at an inner periphery of the front opening end surface of cylindrical portion 111. The longitudinal axis of an outer periphery of second annular projection 16*a* is concentric with the longitudinal axis of cylindrical portion 111. By means of the above construction, the opening end of first cup-shaped portion 112 and the front opening end of cylindrical portion 111 are connected to each other by a faucet joint. O-ring seal element 41 is elastically disposed at a rear end surface of first annular cut-out section 15 to seal the mating surfaces of first annular cut-out section 15 and second annular projection 16*a*.

Third annular cut-out section 17 is formed at an inner periphery of the rear opening end surface of cylindrical portion 111 of compressor housing 11. Consequently, third annular projection 17*a* is formed at an outer periphery of the rear opening end surface of cylindrical portion 111 of compressor housing. Consequently, second annular projection 16*a* is formed at an inner periphery of the front opening end surface of cylindrical portion 111. The longitudinal axis of an inner periphery of third annular projection 17*a* is concentric with the longitudinal axis of cylindrical portion 111. Fourth annular cut-out section 18 is formed at an outer periphery of the opening end surface of second cup-shaped portion 113 of compressor housing 11. Consequently, fourth annular projection 18*a* is formed at an inner periphery of the opening end surface of second cup-shaped portion 113. The longitudinal axis of an outer periphery of fourth annular projection 18*a* is concentric with the longitudinal axis of second cup-shaped portion 113. By means of the above construction, the opening end of second cup-shaped portion 113 and the rear opening end of cylindrical portion 111 are connected to each other by a faucet joint. O-ring seal element 42 is elastically disposed at a rear end surface of third annular cut-out section 17 to seal the mating surfaces of third annular cut-out section 17 and fourth annular projection 18*a*.

Figure 2:
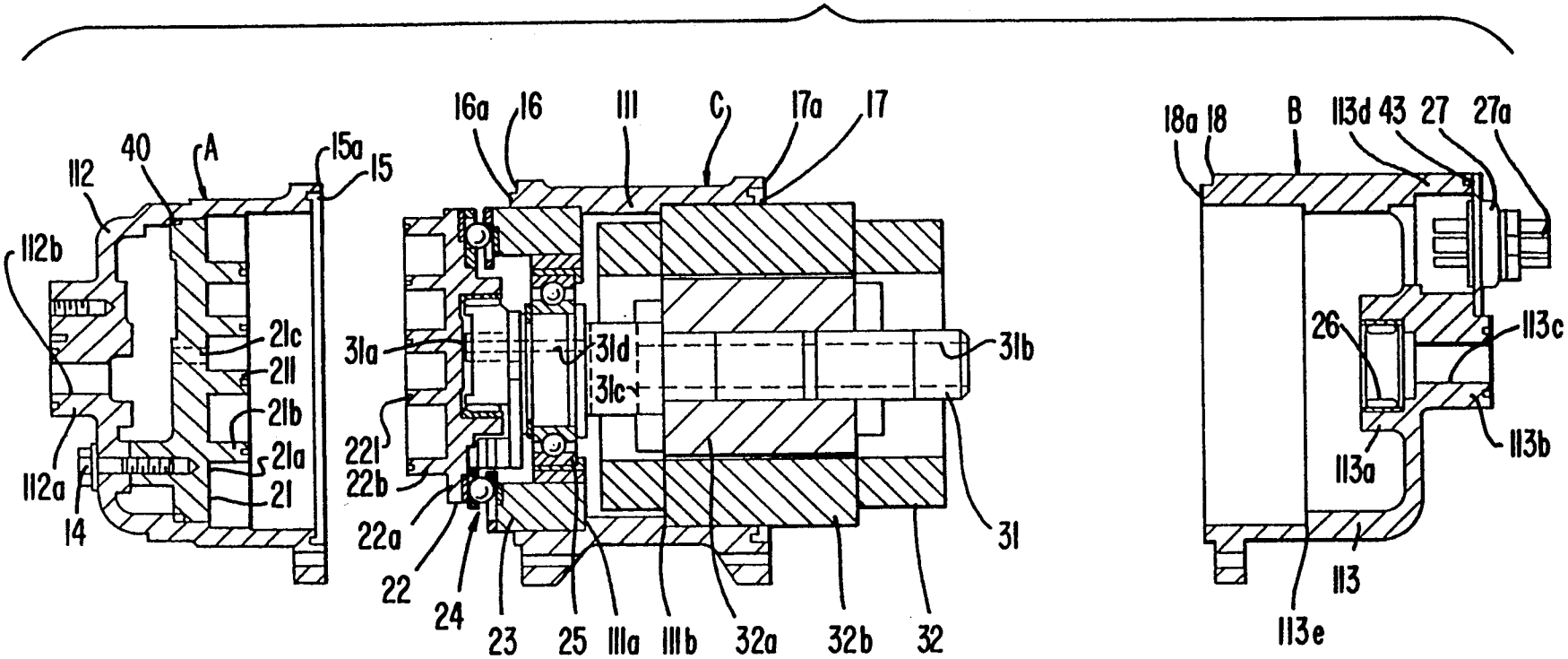
FIG. 2 is an exploded longitudinal sectional view of the motor driven fluid compressor shown in FIG. 1.
Figure 3:
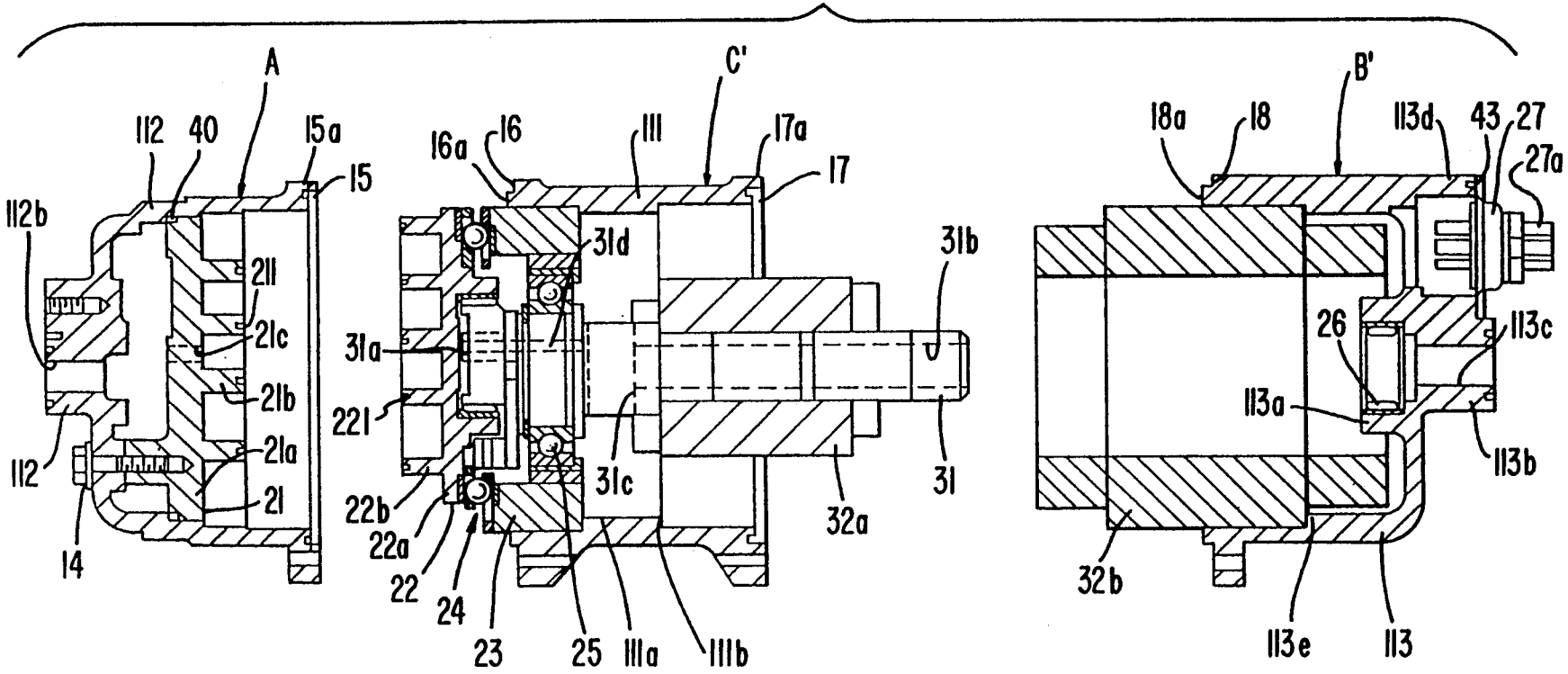
FIG. 3 is another type of an exploded longitudinal sectional view of the motor driven fluid compressor shown in FIG. 1.

FIG. 2 illustrates sub-assemblies A, B and C which are separately prepared, and then are assembled into compressor 10. Sub-assembly A is formed by first cup-shaped portion 112 and fixed scroll 21 which is one of the internal component parts of compressor 10. Sub-assembly B is formed by second cup-shaped portion 113, hermetic seal base 27 and bearing 26 which is also one of the internal component parts of compressor 10. Sub-assembly C is formed by cylindrical portion 111 and the remainder of the internal component parts of compressor 10. Accordingly, the weight of any of sub-assemblies A, B and C does not take an extremely high percentage of the total weight of compressor 10.

Therefore, sub-assemblies A, B and C are handled without difficulty when sub-assemblies A, B and C are required to be transported or to be changed their positions for assembling sub-assemblies A, B and C into compressor 10.

Furthermore, since sub-assemblies A, B and C are separately prepared, it is possible to provide three sub-assembly lines for preparing sub-assemblies A, B and C, respectively. Therefore, so far as each of the three sub-assembly lines does not get out of order at the same time, the whole or a part of the assembly line for the compressor can work so that the assembly line for the compressor can be flexibly managed.

FIG. 3 illustrates sub-assemblies A, B' and C' which are separately prepared, and then are assembled into compressor 10. In FIG. 3, stator 32*b* of motor 32 is fixedly disposed within second cup-shaped portion 113.

Figure 4:
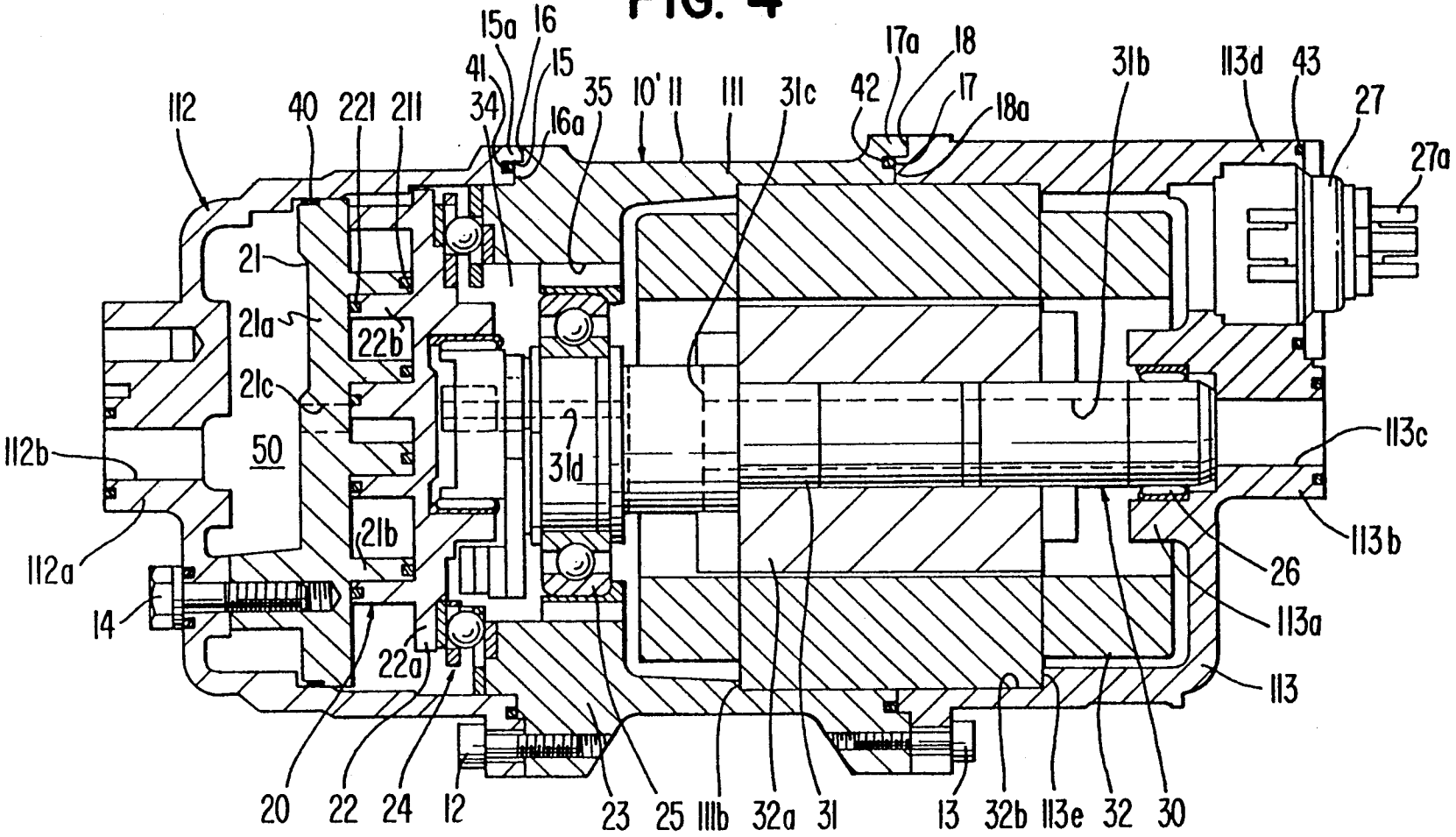
FIG. 4 is a longitudinal sectional view of a motor driven fluid compressor in accordance with a second embodiment of the present invention.

FIG. 4 illustrates an overall construction of a motor driven fluid compressor 10' in accordance with a second embodiment of the present invention. In the construction of this embodiment, inner block 23' extends radially inwardly and is integral with the front opening end of cylindrical portion 111 of housing 11. Other features and aspects of the construction of this embodiment have been described in the first embodiment so that an explanation thereof is omitted.

Figure 5:
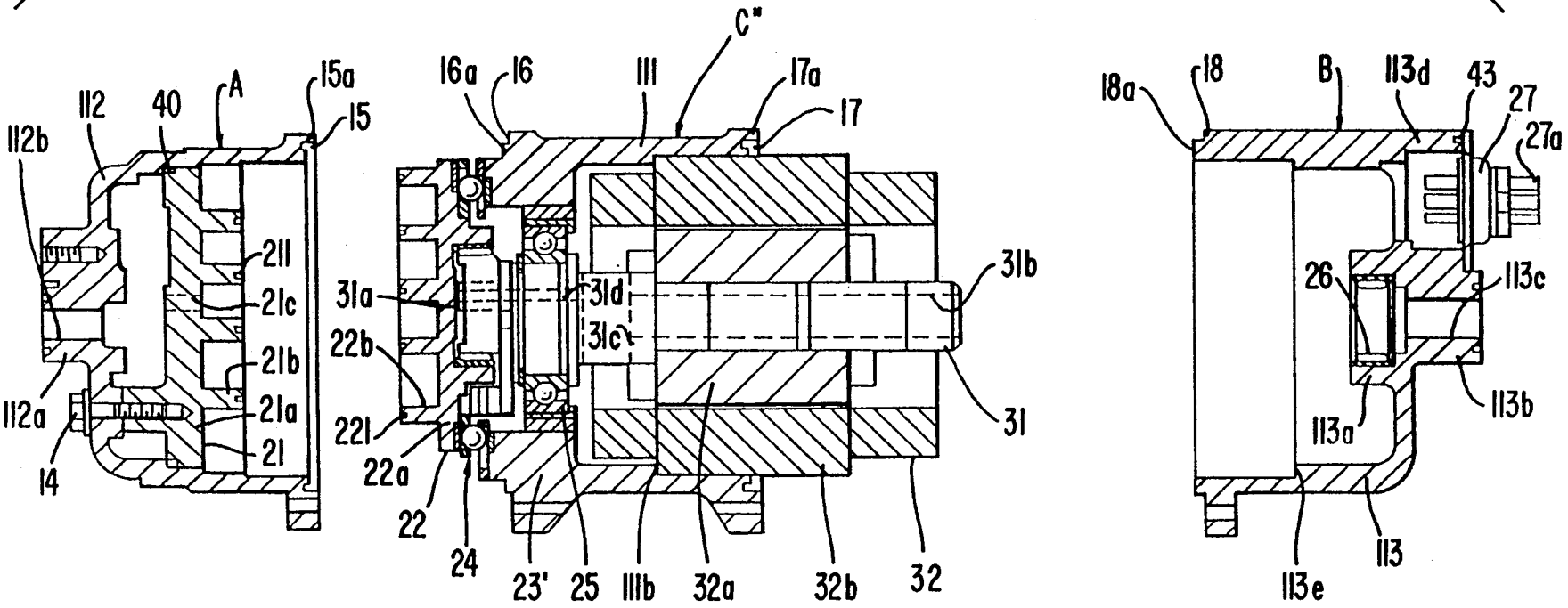
FIG. 5 is an exploded longitudinal sectional view of the motor driven fluid compressor shown in FIG. 4.

FIG. 5 illustrates sub-assemblies A, B and C" which are separately prepared, and then are assembled into compressor 10'. A construction of sub-assembly C" is similar to the construction of sub-assembly C of FIG. 2 other than inner block 23'.

Figure 6:
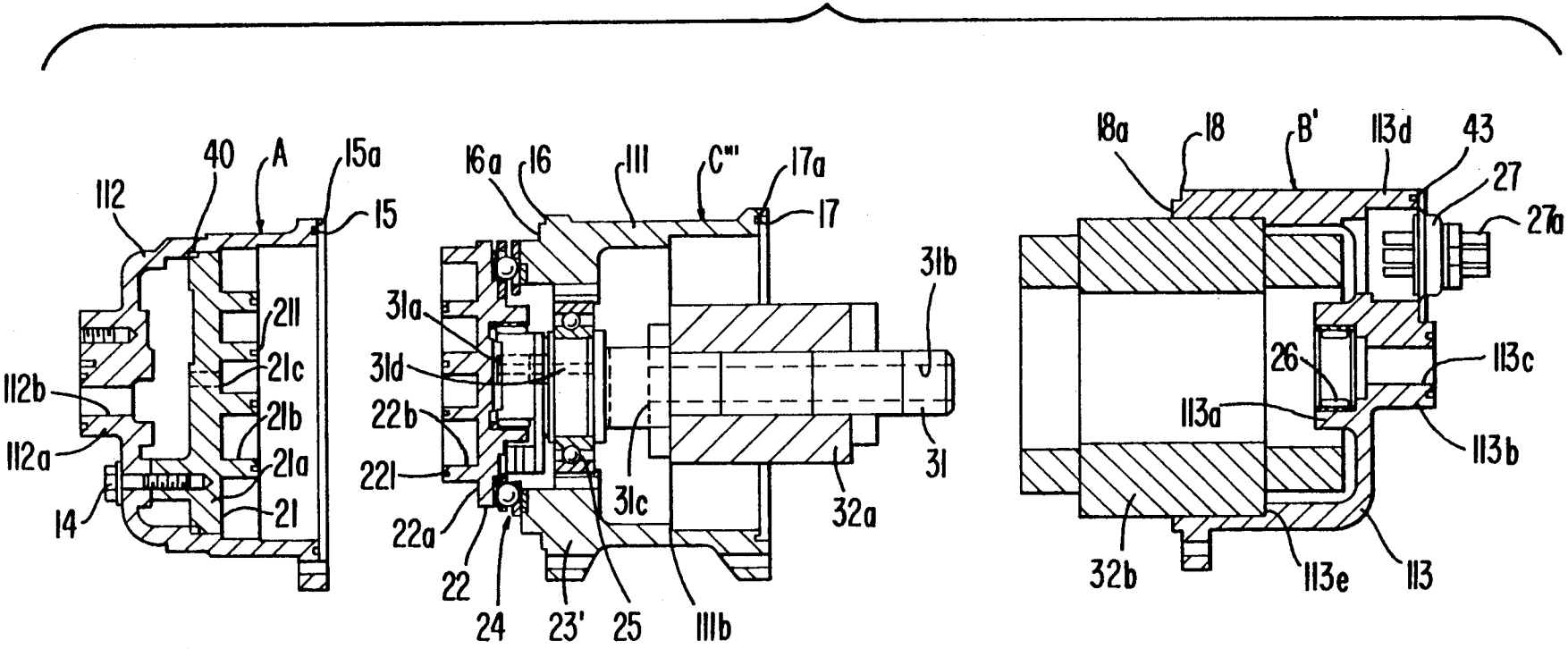
FIG. 6 is another type of an exploded longitudinal sectional view of the motor driven fluid compressor shown in FIG. 4.

FIG. 6 illustrated sub-assemblies A, B' and C''' which are separately prepared. and then are assembled into compressor 10'. A construction of sub-assembly C" is similar to the construction of sub-assembly C' of FIG. 3 other than inner block 23'.

An effect of this embodiment is similar to the effect of the first embodiment so that an explanation thereof is also omitted.

The operation of the compressors in accordance with the first and second embodiments of the present invention will be understood by the artisans in the pertinent technical field so that an explanation thereof is omitted.

I claim:

1. A method of assembling a fluid compressor within a hermetically sealed housing comprising the steps of:

(a) forming a first sub-assembly by attaching to a first housing member one or more components of a compression mechanism, wherein said compression mechanism includes as components a fixed scroll having a first circular end plate with a centrally located valve discharge port and a first spiral element which extends outward from a surface of the first circular end plate and terminates with a first seal element; and an orbiting scroll having a second circular end plate and a second spiral element which extends outward from a surface of the second circular end plate and terminates with a second seal element, wherein the first and second spiral elements interfit with an angular and radial offset and the first seal element mates with the surface of the second circular end plate and the second seal element mates with the surface of the first circular end plate forming at least one fluid pocket which, when the fluid compressor is operating, travels centrally with decreasing volume between the scroll plates and discharges fluid through the valved discharge port of the fixed scroll into a discharge chamber accessible to the exterior of the fluid compressor through an axial hole in the housing member, (b) forming a second sub-assembly by attaching to a second housing member one or more components of said compression mechanism and one or more components of a drive mechanism, wherein said drive mechanism includes as components a drive shaft operably connected to a motor and rotatable supported at each end by bearings, said motor comprising a rotor fixedly surrounding the drive shaft and a stator which surrounds the rotor with a radial air gap;

a pin member which extends from and is integral with one end of the drive shaft and is operably connected to the second circular end plate whereby rotation of the drive shaft brings about rotation of the second circular end plate; and a rotation preventing mechanism so that the orbiting scroll only orbits during rotation of the drive shaft;

(c) forming a third sub-assembly by attaching to a third housing member the remaining components of the compression mechanism and the remaining components of the drive mechanism, and (d) assembling the first, second, and third sub-assemblies by hermetically connecting and sealing the first housing member to the second housing member, and the second housing member to the third housing member, whereby the components of the compression mechanism and the components of the drive mechanism within each housing member operably interconnect to form the fluid compressor.

2. The method of claim 1 wherein the first housing member is hermetically connected and sealed to the second housing member and the second housing member is hermetically connected and sealed to the third housing member with faucet joints.

3. The method of claim 1 wherein the first housing member is hermetically connected and sealed to the second housing member and the second housing member is hermetically connected and sealed to the third housing member with a plurality of bolts.

4. The method of claim 1 wherein the first housing member is hermetically connected and sealed to the second housing member and the second housing member is hermetically connected and sealed to the third housing member by brazing.

5. The method of claim 1 wherein the first housing member is hermetically connected and sealed to the second housing member and the second housing member is hermetically connected and sealed to the third housing member with two or more elastic O-rings between the mated surfaces of said housing members.

6. The method of claim 1 wherein the first housing member is releasable connected to the second housing member, and the second housing member is releasable connected to the third housing member.

7. The method of claim 1 wherein assembly further comprises operably connecting the assembled sub-assemblies to an external cooling unit.

8. The method of claim 1 wherein assembly further comprises operably connecting the assembled sub-assemblies to an external power source.

* * * * *